US005615452A

United States Patent [19]

Habbersett

[11] Patent Number: 5,615,452

[45] Date of Patent: Apr. 1, 1997

[54] LIFT-OFF GUARD GUIDE FOR TILT SHOE

[75] Inventor: John I. Habbersett, Rochester, N.Y.

[73] Assignee: Caldwell Manufacturing Company, Rochester, N.Y.

[21] Appl. No.: 435,886

[22] Filed: May 5, 1995

[51] Int. Cl.[6] ..... E05D 15/22

[52] U.S. Cl. ..... 16/194; 49/181; 49/453

[58] Field of Search ..... 16/194, 196, 197; 49/181, 453

[56] References Cited

U.S. PATENT DOCUMENTS

| | | | |
|---|---|---|---|
| 4,079,549 | 3/1978 | Wood | 49/453 |
| 4,446,654 | 5/1984 | Schoolman et al. | 49/453 |
| 4,718,194 | 1/1988 | FitzGibbon et al. | 49/453 |
| 5,127,192 | 7/1992 | Cross | 49/453 |

*Primary Examiner*—M. Rachuba
*Assistant Examiner*—Donald M. Gurley
*Attorney, Agent, or Firm*—Eugene Stephens & Associates

[57] ABSTRACT

A guard guide surface for the lift-off slot of a tilt sash shoe is disposed obliquely above the lift-off slot to engage the head of a sash pin rising directly vertically from the slot. This prevents accidental withdrawal of a sash pin from a shoe when the sash is tilted. When the sash is slanted, however, for intentional withdrawal from a window, the sash pins can be lifted from their slots in off-vertical motions that clear the guide surface.

17 Claims, 2 Drawing Sheets

LIFT-OFF GUARD GUIDE FOR TILT SHOE

TECHNICAL FIELD

This invention involves counterbalanced lift-off shoes for tilt window sash.

BACKGROUND

A lift-off shoe system for a tilt window, such as shown in U.S. Pat. No. 4,941,285, involves counterbalanced shoes that do not lock when a sash is tilted. Non-locking shoes rise to an equilibrium position when a sash is tilted, causing part of its weight to be removed from the counterbalanced shoes. Then sash pins can be lifted up out of shoe slots for removing a sash from a window.

Sash pins for non-locking, lift-off shoes pivot freely within shoe slots as a sash tilts and have heads that interlock with the shoe slots during normal operation. Removing a sash from the window requires tilting the sash out of the plane of the window to a position approximately normal to the plane of the window and then slanting the sash to lift an upper sash pin out of its shoe slot, followed by raising the remaining sash pin from its slot in the opposite shoe. Lift-off shoes can also be made to lock in place when a sash is tilted. Then a sash can be slanted as its sash pins are lifted clear of locked shoes.

Tilting a sash that is biased by non-locking, lift-off shoes reduces the sash weight supported by the shoes and allows them to rise under the force of counterbalance springs. Depending on the height of the sash when it is tilted, the sudden rising of the bottom of a tilted sash can surprise people inexperienced with this phenomenon. A person surprised by this may attempt to catch hold of the tilted sash and support its weight against possible accident, and this may lift the sash pins prematurely out of shoe slots and leave the sash unsupported.

I have devised a simple remedy that inhibits any premature or unintentional lifting of sash pins from shoe slots. My solution is easily integrated into all the existing types of lift-off sash shoes and can accomplish its safeguarding function very economically.

SUMMARY OF THE INVENTION

My improvement in a lift-off tilt sash shoe disposes a guard above the sash pin slot where it intersects a space vertically above the resting position of the sash pin. The guard is configured and positioned to block direct vertical movement of a sash pin rising straight up from a shoe slot with a tilted but unslanted sash and to allow off-vertical motion of a sash pin rising in an arc as a sash is slanted and has its upper edge lifted. This allows the sash pin to be lifted from the sash pin slot in an off-vertical arc motion that occurs when the sash is intentionally slanted for removal from a window; but it prevents any direct vertical lift-off of a sash pin from a slot, which might occur accidentally with a tilted but unslanted sash.

The same guard can serve as a guide for a sash pin reentering a shoe slot. The function of the guard when serving as a guide surface is to allow the sash pin to move farther into the shoe as the sash pin moves downward toward the slot.

Relative to a headed sash pin resting in a shoe slot, the guard guide surface extends from a frame side of the sash pin head obliquely upward to a sash side of the pin head. The surface is thus inclined from vertical and can be plane. It is preferably molded integrally into the shoe with the pin slot, and it can add to the strength of the shoe.

DRAWINGS

DETAILED DESCRIPTION

Figure 1:
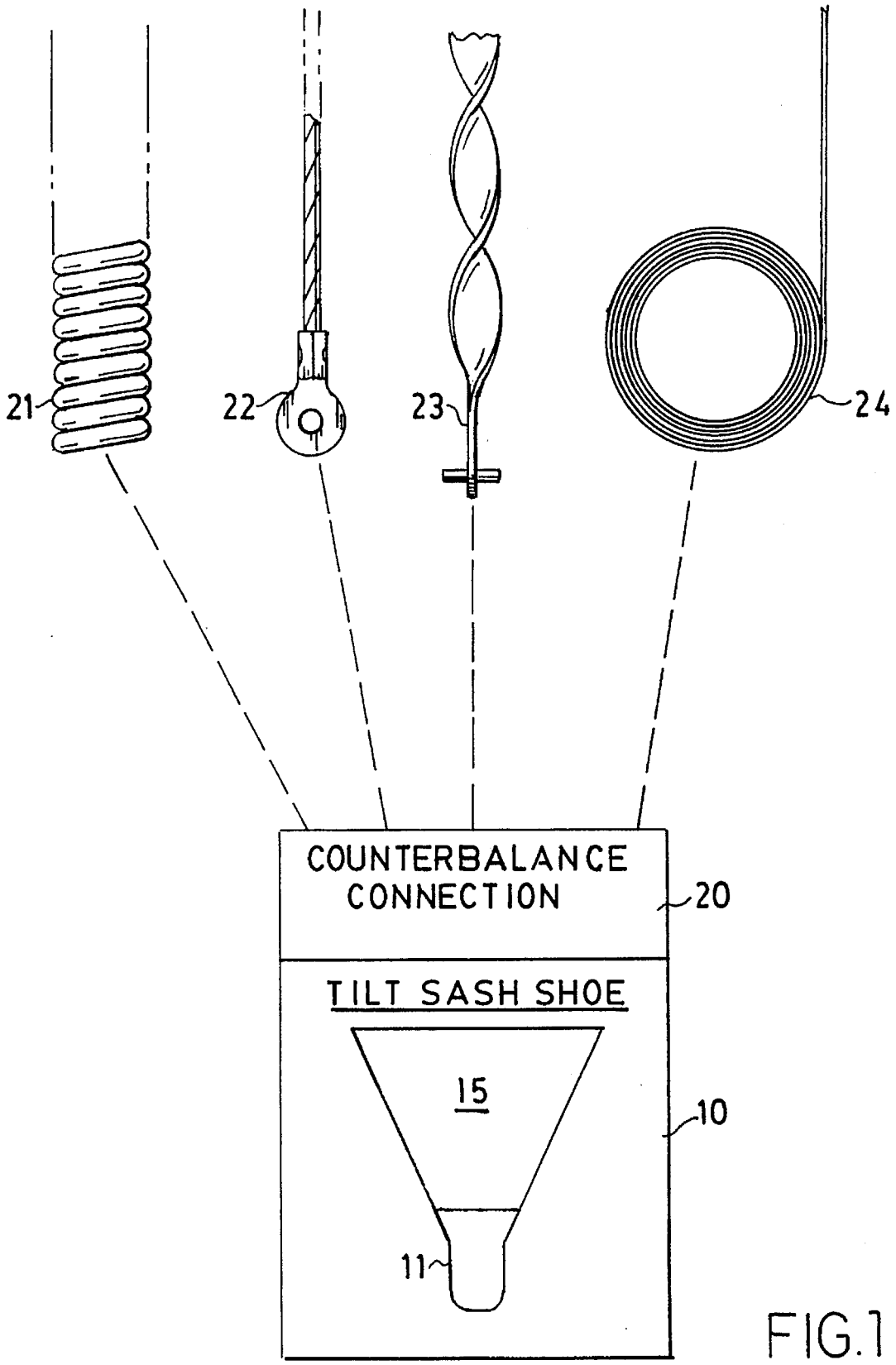
FIG. 1 is a schematic front elevational view of a guard guide for a lift-off tilt sash shoe that can be counterbalanced by a variety of springs.

Lift-off sash shoe 10 is shown schematically in the drawings as formed of a block of molded resin material. In actual practice, the molding of shoe 10 uses cores that form recesses in regions where plastic is not needed for strength or structural purposes, to reduce the molding time and the amount of plastic used. The preferred coring out of shoe 10 is well understood in the molding art and is omitted for simplicity of illustration.

The parts of shoe 10 that are important to the invention are a lift-off slot 11, a guard guide surface 15, and a schematically illustrated counterbalance connection 20, which can be an integral part of shoe 10. Counterbalance connection 20 is configured to interconnect with a preferred one of several available counterbalance spring systems. Each of these exerts an upward bias on shoe 10 that counterbalances the weight of a supported sash, and each requires a generally known connection to sash shoe 10. The illustrated counterbalance elements include a coiled tension of extension spring 21 (an example is shown in U.S. Pat. No. 4,941,285), a terminal connector 22 for a cord of a block and tackle spring counterbalance system (an example is shown in U.S. Pat. No. 4,689,850), a torsion balance 23 (an example is shown in U.S. Pat. No. 5,267,416), and a constant force or curl spring balance 24 (an example is shown in U.S. Pat. No. 5,353,548). Other counterbalance systems are also possible, but are not currently popular. Any of these can also be connected to shoe 10 to exert the necessary upward bias.

When a curl or constant force spring balance 24 is used to bias shoe 10, convolutions of spring 24 are preferably held by or contained in the counterbalance connector 20 portion of shoe 10 so that spring 24 uncoils upward from shoe 10 or connector 20. This applies the recurl tendency of the spring to exert a lift on shoe 10. Coiled convolutions of spring 24 can also be fixed above shoe 10 for uncoiling downward with movement of shoe 10, but this is less preferred.

Figure 2:
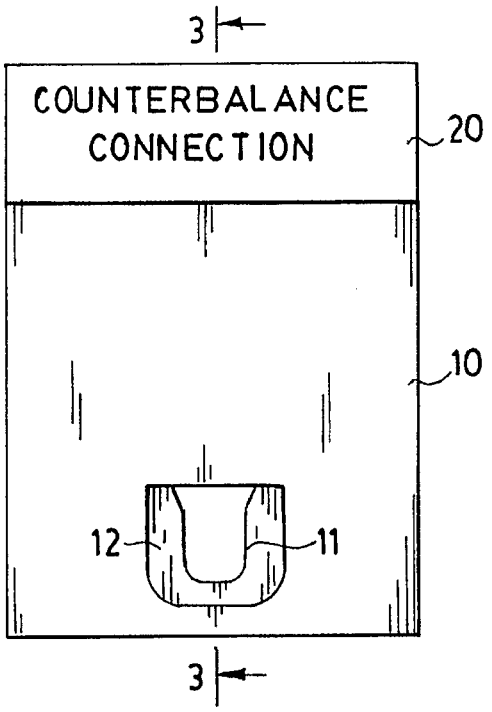
FIG. 2 is a schematic rear elevational view of the shoe of FIG. 1.
Figure 3:
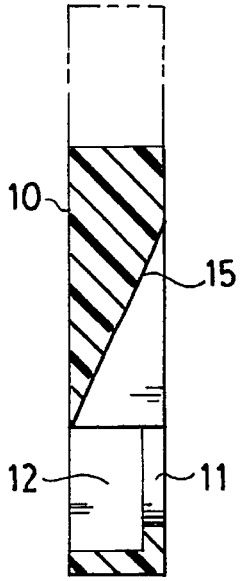
FIG. 3 is a partially schematic cross-sectional view of the shoe of FIG. 2, taken along a line 3—3 of FIG. 2.
Figure 4:
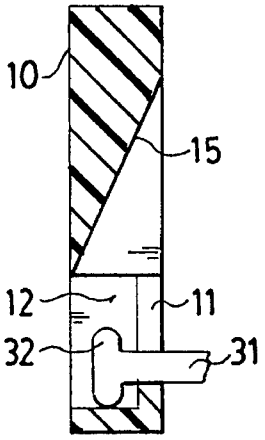
FIGS. 4 and 5 are cross-sectional views similar to FIG. 3 but showing a headed sash pin in a rest position in FIG. 4 and in a slanted lift-off or reinsertion position in FIG. 5.
Figure 5:
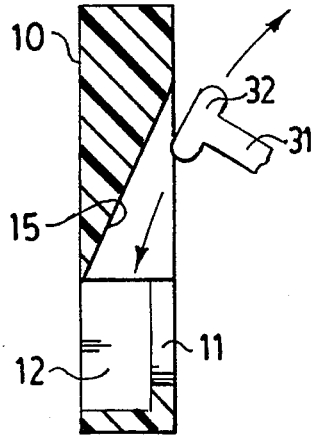

The rear or frame side of shoe 10, as shown in FIG. 2, has an enlarged recess 12 extending around slot 11 to receive a head 32 of a sash pin 31 (shown in FIGS. 4 and 5). Head 32 is then trapped on the frame side of slot 11 while the neck or stem portion of pin 31 extends through slot 11 to engage a sash. This allows pin 31 to pivot freely in shoe 10 as a sash is tilted, and it also ensures that pin 31 cannot disengage from shoe 10 during shipping of a preassembled unit.

Guard guide surface 15 is shown as a plane surface inclined from vertical, but it can also be curved. Surface 15 is disposed above the rest position of pin head 32 and above slot 11 to intersect a space vertically above pin head 32 and slot 11.

Sash pin 31 connects to the bottom of a sash that is free to tilt while pin head 32 and pin 31 rotate freely in recess 12 and slot 11, respectively. Any direct vertical movement of pin head 32 caused by lifting the bottom of a tilted but unslanted sash moves pin head 32 straight up into engagement with guard surface 15, which prevents accidental escape of pin 31 from shoe 10. This also prevents any accidental loss of support for the bottom of a tilted sash by ensuring that sash pins 31 remain within shoes 10 unless the sash is slanted.

Removing a sash from a window requires that the sash first be tilted about 90° from the plane of the window and then slanted to elevate one sash pin and one sash shoe higher than another. Then the upper edge of the slanted sash and its pin 31 are lifted in an arcuate motion in an off-vertical direction, as shown by the arrows in FIG. 5, which moves pin head 32 clear of guard surface 15 and obliquely out of shoe 10. Guard surfaces 15 thus require that a sash be slanted and lifted in an arc to be removed from a window, which prevents accidental removal of a sash that is not slanted. The sudden rising of the bottom of a tilted sash under the force of counterbalance springs cannot lead to any sash pin withdrawal from a sash shoe because an initially tilted sash is not slanted.

The optimum angle for guard guide surface 15 to accommodate an arcuate lifting motion of pin head 32 varies predominantly with the slant of the sash and the width of the sash. The amount a sash can be slanted is limited by the clearance afforded by the pin heads 32 lodged in recesses 12, since shoes 10 are trapped in shoe channels of jamb liners. Slanting a sash ten or more degrees is preferably possible. The arcuate lifting motion of pin head 32 also depends in part on the width of the slanted sash, which can vary considerably in modern windows. Practical experience shows that these parameters can be accommodated by angling guide surface 15 by about 25° from vertical, although considerable variation in the guide surface angle is possible.

Replacing a removed sash also requires slanting the sash to maneuver the sash pins back into the shoes. Guard surfaces 15 then serve as guides allowing a sash pin head 32 to move farther into a shoe as the pin 31 moves downward in an off-vertical direction into slot 11.

I claim:

1. In a counterbalanced tilt sash shoe having a lift-off slot for a headed sash pin, an improvement comprising:

a. a guard disposed above the sash pin slot to intersect space vertically above the sash pin slot; and b. the guard being configured and positioned to block vertical motion of a sash pin rising from the slot with an unslanted sash and allow off-vertical motion of a sash pin rising from the slot with a slanted sash.

2. The improvement of claim 1 wherein the bottom of the guard is positioned on a frame side of the shoe in a region above the slot.

3. The improvement of claim 2 wherein the top of the guard is positioned on a sash side of the shoe.

4. The improvement of claim 1 wherein the guard is configured as an inclined plane surface.

5. The improvement of claim 1 wherein the slot and the guard are integrally molded of resin material.

6. The improvement of claim 1 wherein an upward bias of a counterbalance is applied to an upper region of the shoe.

7. A guide for a head of a sash pin received in a lift-off slot in an upwardly biased tilt sash shoe, the guide comprising:

a. a surface disposed above the slot to extend downward from a sash side of the shoe toward a frame side of the shoe; and b. the surface being configured so that the head of a sash pin being lowered into the slot from a sash side of the slot is allowed by the surface to move farther into the shoe as the sash pin moves downward toward the slot.

8. The guide of claim 7 wherein the bottom of the surface is above the slot.

9. The guide of claim 7 wherein the surface is a plane surface inclined from vertical.

10. The guide of claim 7 wherein an upward bias of a counterbalance is applied to an upper region of the shoe.

11. The guide of claim 7 wherein the slot and the guide are integrally molded of resin material.

12. An upwardly biased tilt sash shoe having a lift-off slot for receiving a headed sash pin, the shoe comprising:

a. a guard guide surface disposed to intersect a space vertically above and proximate to a headed sash pin resting in the slot; and b. the guard guide surface extending from a frame side of the sash pin head obliquely upward to a sash side of the pin head.

13. The shoe of claim 12 wherein the bottom of the guard guide surface is above the sash pin head.

14. The shoe of claim 12 wherein the guard guide surface is a plane surface inclined from vertical.

15. The shoe of claim 12 wherein the slot and the guard guide surface are integrally molded of resin material.

16. The shoe of claim 12 wherein a sash pin head entering the shoe from the sash side of the shoe above the slot is allowed by the surface to move farther into the shoe as the pin head moves downward along the guard guide surface.

17. The shoe of claim 12 wherein an upward bias of a counterbalance is applied to an upper region of the shoe.

* * * * *